United States Patent [19]

Crispo

[11] Patent Number: 5,024,639

[45] Date of Patent: Jun. 18, 1991

[54] "Z" TYPE STEERABLE BALANCED POWER TRANSMISSION

[76] Inventor: Cesare Crispo, Via Milano, 29, 20090 Cusago, Italy

[21] Appl. No.: 476,708

[22] Filed: Feb. 8, 1990

[30] Foreign Application Priority Data

Mar. 29, 1989 [IT] Italy ..... 19929 A/89

[51] Int. Cl.[5] ..... F16H 1/38

[52] U.S. Cl. ..... 475/221; 440/58; 440/59

[58] Field of Search ..... 440/58, 59, 60, 75; 475/221; 74/606 R

[56] References Cited

U.S. PATENT DOCUMENTS 2,372,247 3/1945 Billing ..... 440/59 X
3,021,725 2/1962 Schneider ..... 440/58 X
3,094,967 6/1963 Willis, Jr. ..... 440/58
3,486,478 12/1969 Halliday ..... 440/58
3,511,209 5/1970 Becker ..... 440/58
4,932,907 6/1990 Newman et al. ..... 440/58 X

*Primary Examiner*—Dirk Wright
*Attorney, Agent, or Firm*—Douglas B. White

[57] ABSTRACT

A "Z" type power transmission including a steerable housing having a propeller shaft exiting therefrom. The steerable housing is mounted to a drive housing in a manner which allows rotational motion relative to the drive housing. The drive housing receives the drive shaft and steering control from the vessel and is arranged for selective vertical pivotal movement about the axis of the drive shaft to elevate the transmission. Drive force transmission between the steerable and drive housings is accomplished by use of coaxial shafts. Steering torque is provided to the drive housing along the same axis as the drive shaft so as to maintain both drive and steering torque during elevation of the unit.

21 Claims, 6 Drawing Sheets

102
104
89
91
103
105
90
106
88'
88
92
93
84
94
66
97
95
96
99

85
86
87
100
98
101
83
84

Prior Art

"Z" TYPE STEERABLE BALANCED POWER TRANSMISSION

DESCRIPTION

The present industrial patent concerns a power transmission of the "Z" type used in particular, but not exclusively, in the field of marine propulsion. It is associated with an inboard motor and transmits power to a horizontal propeller shaft placed so that the propeller does not interfere with the boundary layer. The most commonly used transmission of this type is the one that exits from a flat surface at the stern and, in nautical terminology, is called "in board /out board transmission" and stern drive.

The "Z" type outboard power transmission produced commercially until now steers the craft by orientating the axis of the propeller with respect to the longitudinal axis of the boat, with the disadvantage that such orientation gives a maximum angle of 30° right and 30° left and reverse is obtained by reversing the direction of rotation of the propeller. Such conventional transmission also has the disadvantage that, due to the presence of a double universal joint on the transmission, it can only be raised on a vertical plane to a maximum of around 50 °.

As is well-known, for maneuvering in restricted sea room, it is necessary to be able to orientate the propeller in any azimuthal direction so that the maneuverability of the craft can be used to maximum advantage. It is also necessary to be able to raise the outboard stalk completely in a vertical plane for inspections, and/or to be able to control such elevation with respect to the desired direction of thrust, which means, for planing hulls, a variety of attitudes.

The objective of being able to direct the thrust in any direction on the horizontal plane, independently of elevation, from what can be gathered from the description of related patents, has been achieved until now with complicated mechanisms based on the torque balancing system or a normal "Z" transmission with servo-assisted steering mechanisms, which are slow and cannot be reversed. The torque balancing system is described in the following patents: U.S. Pat. No. 2,755,765, U.S. Pat. No. 3,094,967, GB 975,436, DE 1,165,442, U.S. Pat. No. 3,486,478, U.S. Pat. No. 3,750,616, U.S. Pat. No. 3,851,614 and U.S. Pat. No. 4,619,158.

The system with a servo-assisted steering mechanism is described in the following patents: U.S. Pat. No. 2,499,339, U.S. Pat. No. 2,532,470, U.S. Pat. No. 3,217,688, U.S. Pat. No. 3,452,703, U.S. Pat. No. 3,554,155, U.S. Pat. No. 3,707,939, U.S. Pat. No. 3,769,930, U.S. Pat. No. 3,795 219, U.S. Pat. No. 4,074,652, U.S. Pat. No. 4,516,940 and U.S. Pat. No. 4,634,389.

Full elevation of the stalk has been dealt with in U.S. Pat. No. 4,516,940 and dismountability in U.S. Pat. No. 4,634,389. In these cases, however, the stalk is separate and the transmission interrupted.

An aim of the present invention is to provide a "Z" type power transmission of the above-mentioned type with a device designed to allow azimuthal orientation of the axis of the propeller or propellers through 360° while, naturally, maintaining the transmission in operation.

Another aim of the invention is to provide such a transmission designed to be raised in a vertical plane by rotating the structure comprising the stalk through 180° with respect to its normal position while likewise maintaining the power transmission in operation.

These and other aims of the invention will become apparent to those knowledgeable in the art from the description and claims which follow, especially considering that the present power transmission is suitable for use, in particular, in the marine field, and may also be used in other fields such as, for example, aeronautics and wind energy.

The power transmission of the invention is the type comprising:

a first housing associated with an active member;

a second housing associated with a first shaft transmitting energy to said active member;

a pair of coaxial counter- rotating shafts interposed between said first and second housing;

means contained in said second housing for rotating said first housing around a vertical axis common to the axes of said pair of coaxial counter-rotating shafts; and it is essentially characterised by the fact that it provides:

means interposed between said first shaft and said active member capable of providing reciprocal rotation between said first housing and said second housing while maintaining the power transmission in operation.

According to a further characteristic, said drive shaft is coaxial to and opposite a second shaft representative of the torque applied to said means for rotating said first structure.

The invention is illustrated by typical arrangements in the figures appended hereto, in which.

Figure 7:
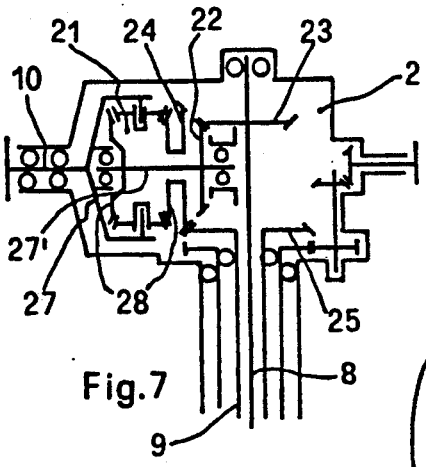
Figure 11:
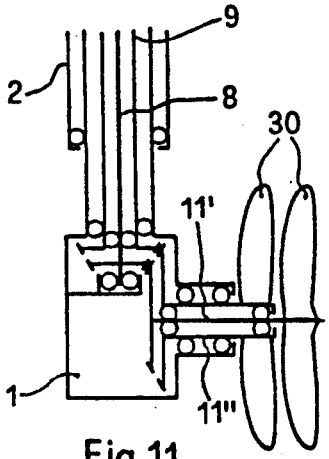
Figure 15:
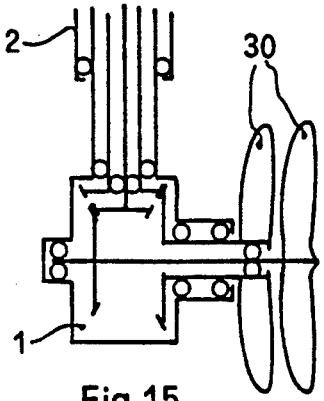
Figure 18:
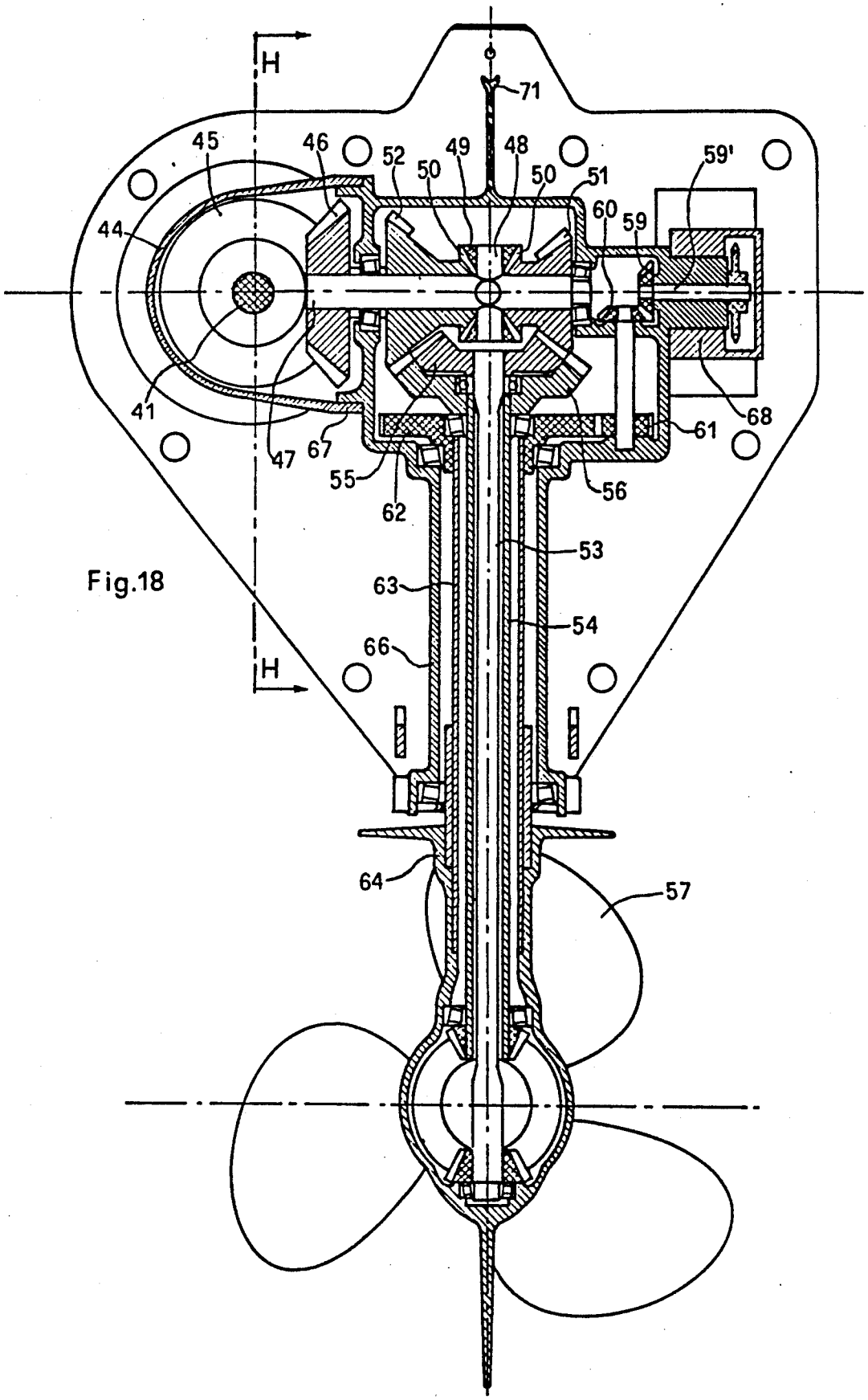
Figure 19:
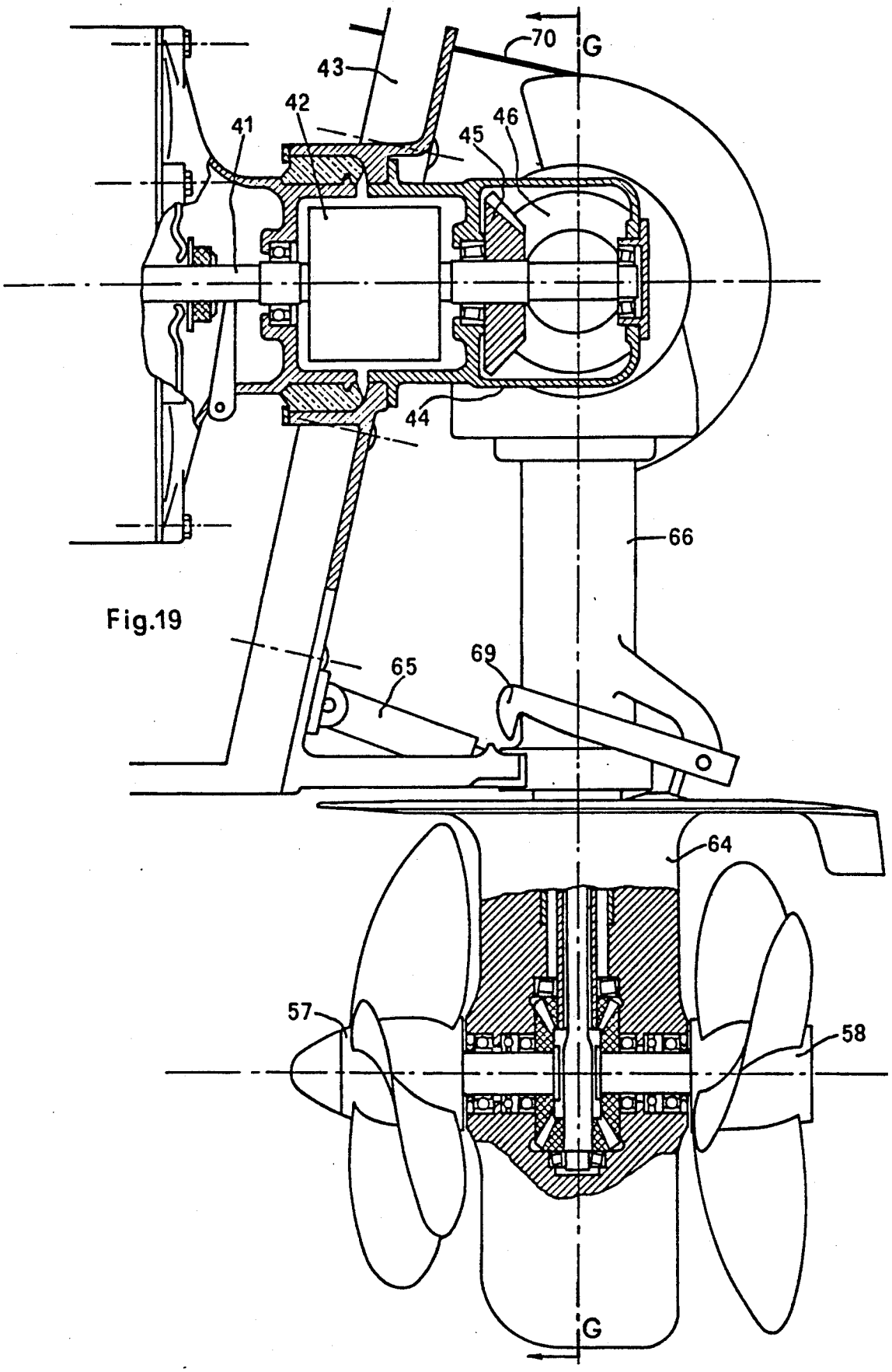
Figure 20:
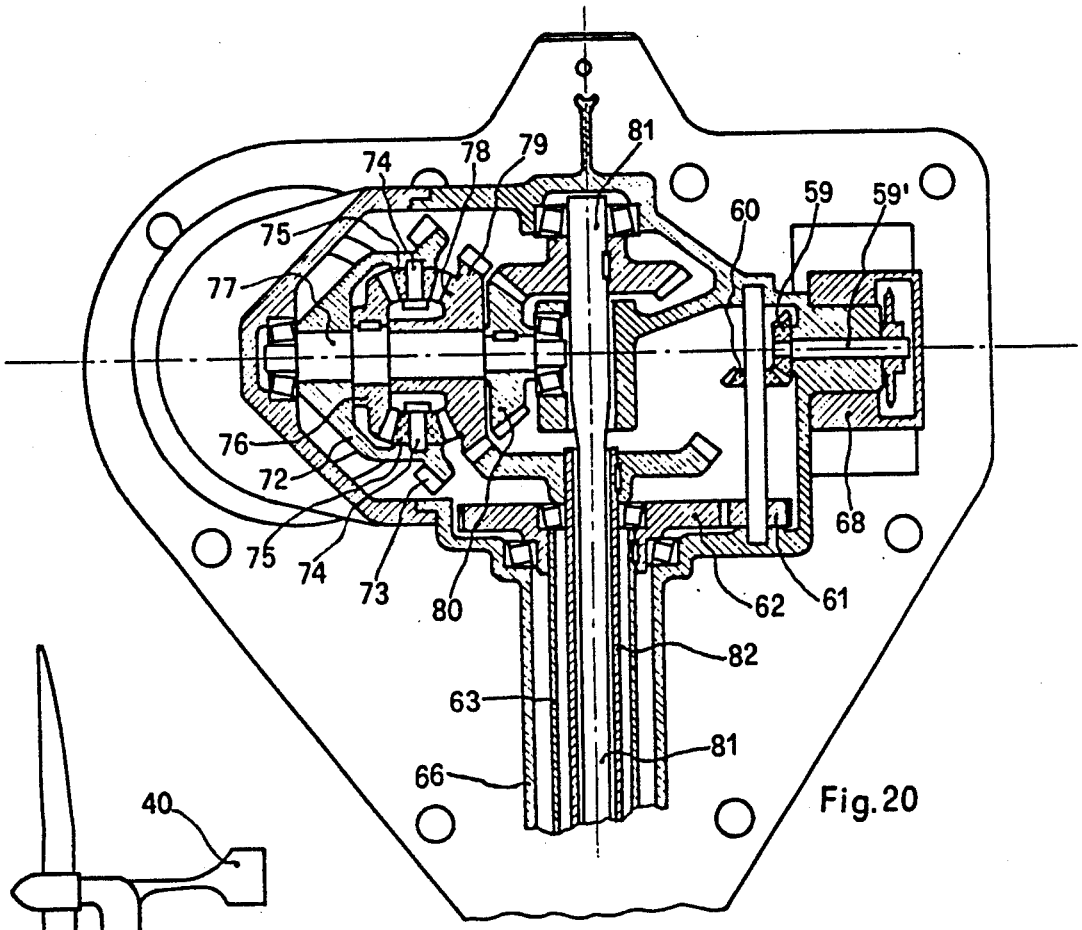
Figure 16:
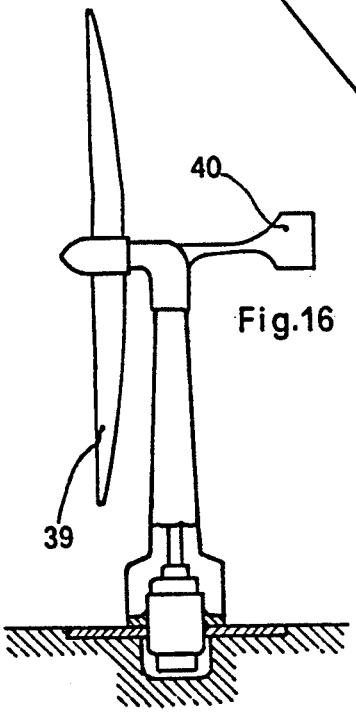
Figure 17:
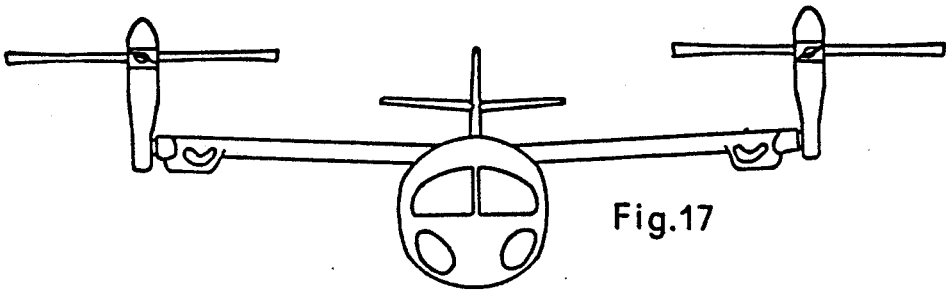
Figures 21, 22:
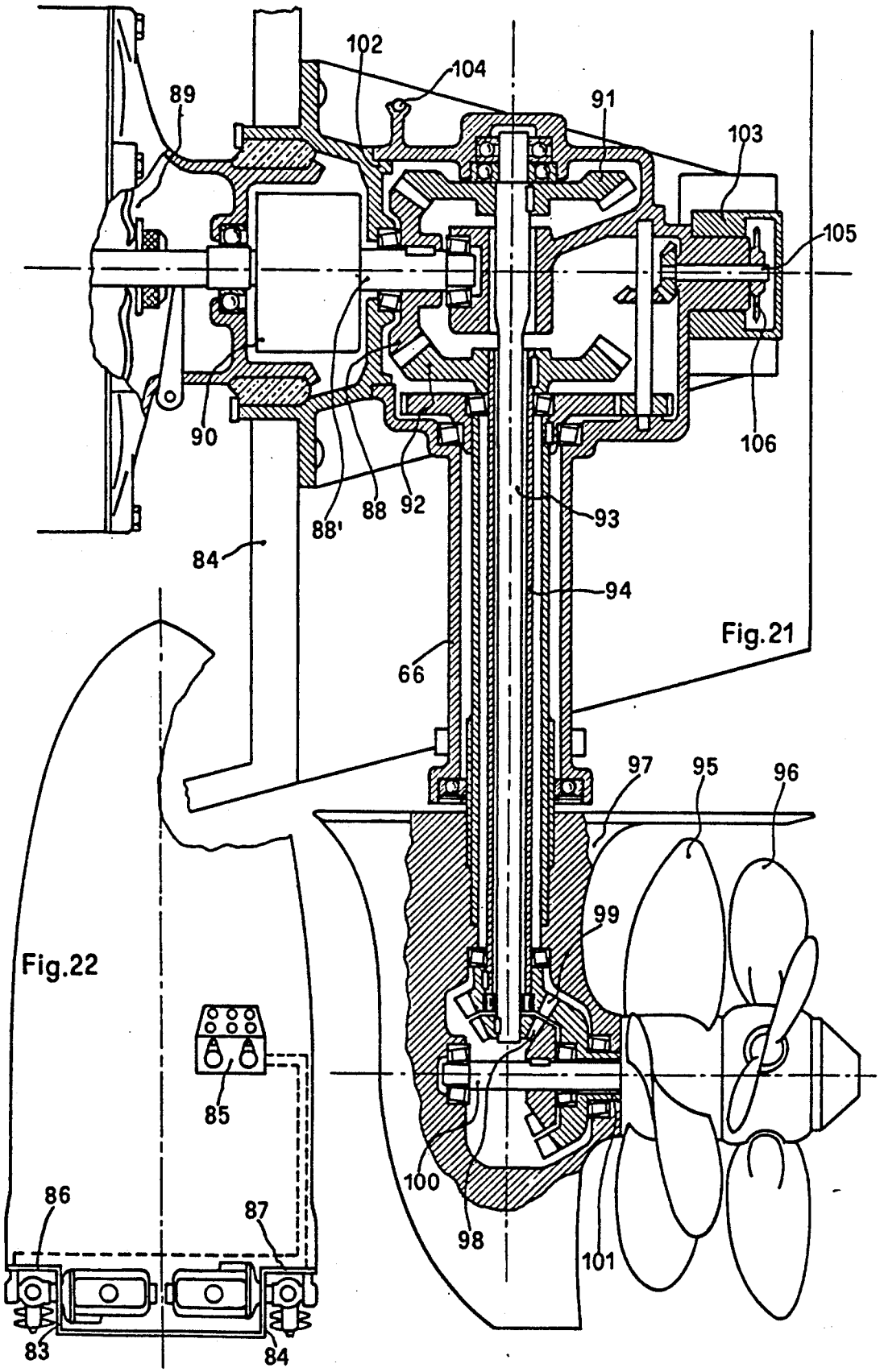
Figure 5:
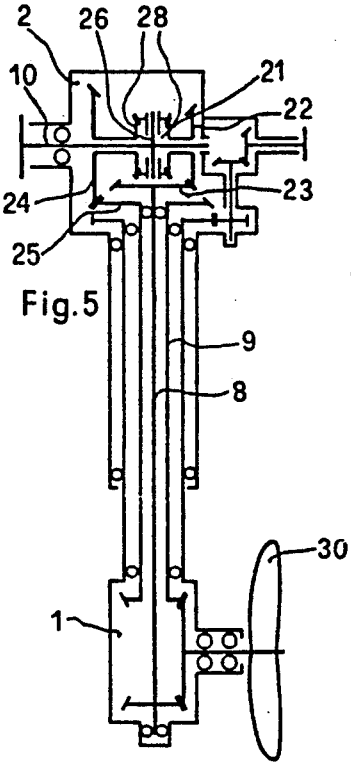

Each of FIGS. 4 to 15 illustrates diagramatically a further form of execution of the "Z" type power transmission, with a steering system, according to further forms of execution of the invention;

FIG. 16 illustrates a particular application of the power transmission according to FIGS. 3–15 in the field of wind energy exploitation;

FIG. 17 illustrates a particular application of the power transmission according to FIGS. 3–15 in the field of aeronautics;

FIG. 18 represents a practical example of a power transmission according to the arrangement of FIG. 5 through section G—G of FIG. 19;

FIG. 19 is a section through H—H of FIG. 18;

FIG. 20 represents, through a section, a practical example of a power transmission according to the arrangement of FIG. 7;

FIG. 21 represents, through a section, a practical example of a power transmission according to the arrangement of FIG. 11;

FIG. 22 diagramatically represents two power transmissions according to FIG. 21 applied to a planing hull.

Figure 1:
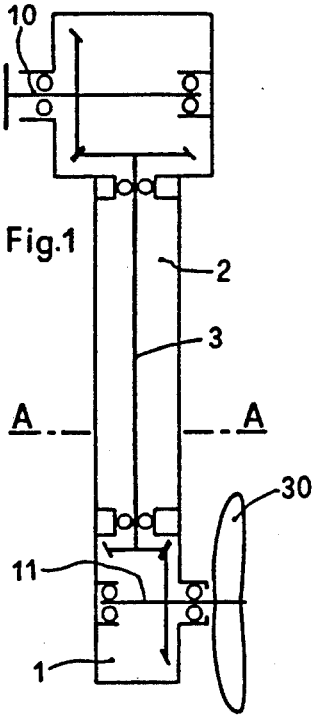
FIG. 1 illustrates diagramatically a conventional "Z" type power transmission applies to a marine propulsion unit excluding the steering system.

The arrangement of a traditional "Z" transmission, excluding the steering system, is considered to be that of FIG. 1.

To enable the axis of the propeller to be orientated fully, the area containing the vertical transmission shaft must be sectioned through a plane marked A—A on FIG. 1, and a mechanism applied enabling the rotation of stalk 1 to be controlled with respect to the upper part or casing 2.

However, this mechanism, the operation of which constitutes the steering of the boat or craft, must support the reaction to the torque transmitted by internal shaft 3, a reaction which passes through the frame at the section considered.

The thesis imposed is that of annulling this reaction to enable the mechanism in question to be moved by a force of low value. In this case, by sectioning the frame, thereby eliminating the reaction in it, stalk 1 indeed remains stable with the power transmission in operation. By transmitting the movement through section A—A of FIG. 1 by means of two coaxial counter-rotating shafts with equal and opposite torques, the reaction absorbed by the frame is nil. This condition is achieved in the arrangement in FIG. 2 in which bevel gears 4 and 5 are equal, as are gears 6 and 7.

Considering this type of transmission when stopped, it is noted that the rotation of stalk 1 around a common axis with the upper part 2 is prevented by the shaft and conjugate gear arrangement required to reciprocally rotate intermediate internal 8 and external shaft 9.

For clarity, referring for simplicity to FIG. 1, the "Z" configuration of the transmission is defined by drive shaft 10, vertical shaft 3 and propeller shaft 11.

Figure 2:
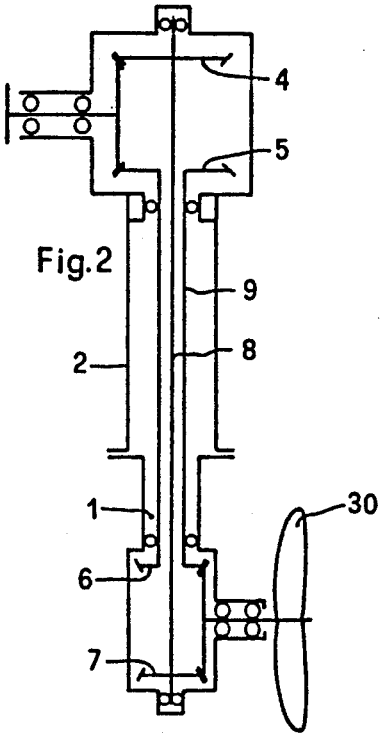
FIG. 2 illustrates diagramatically a hypothetical "Z? type power transmission applied to a marine propulsion unit.

The present invention, starting with the arrangement in FIG. 2 (counter-rotating shafts, hence cancellation of the reaction), contemplates four fundamental modes by which it is possible to rotate stalk 1, not only on the vertical axis but also and simultaneously, if desired, on a higher horizontal axis of rotation to raise the assembly comprised of stalk 1 and the upper part or casing 2 in a vertical plane. Each of these four modes is represented diagramatically in FIGS. 3,4,5 and 6 as well as some variants of the mode of FIG. 5 in FIGS. 7–10 and some variants of the mode of FIG. 6 in FIGS. 11–15.

As can be noted, all of these arrangements have as a common fundamental and exclusive principle, developed further with each example, the fact that the steering torque enters the top casing 2 by means of a shaft coaxial and opposite to the one which transmits the propulsive energy, such that, by permitting casing 2 to rotate around the said horizontal axis, the continuity of the two transmission on entry inside the said top casing is maintained. Consequently, all of the internal mechanisms are capable of meeting these conditions.

Figure 3:
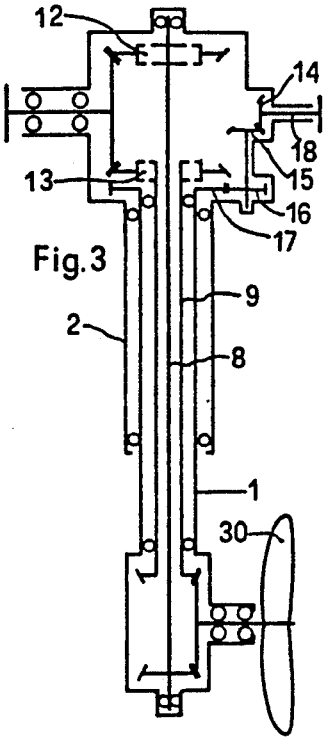
FIG. 3 illustrates diagramatically a "Z" type power transmission, with a steering system, applied to a marine propulsion unit according to one form of execution of the invention.

FIG. 3 concerns the case in which overrunning clutches 12 and 13 are interposed along each counter-rotating shaft 8 and 9.

Thus, when the power transmission is operating, stalk 1 maintains a stable position unless there is a moment present tending to make it rotate. The value of this moment must be equal to or greater than that transmitted at the same time by one of the shafts; this moment is transmitted to stalk 1 through the series of gears 14,15,16 and 17 and relative shafts of which, it is to be observed, input shaft 18 is representative of that moment and is also the steering shaft. Gear 17 is integral to stalk 1. In this solution the interposition of a friction clutch on drive shaft 10 is appropriate and the use of an auxiliary rudder is advisable for small changes of course. In this case, stalk 1 should be maneuvered preferably when the motor is transmitting low power.

In general this type of transmission can be adopted for medium sized vessels such as ferries and tugs and for sailing boats with an auxiliary engine.

Figure 4:
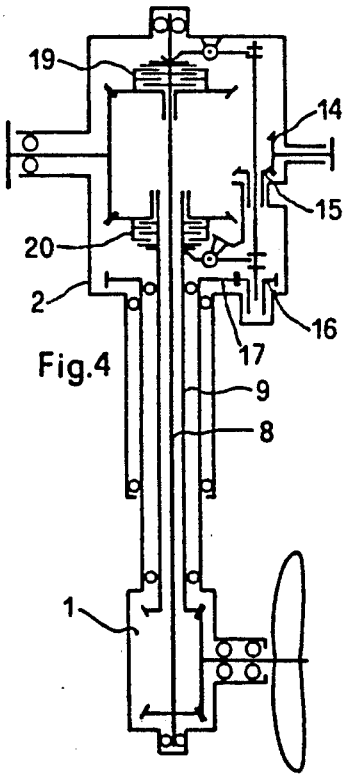

FIG. 4 concerns the case in which friction clutches 19 and 20 are interposed on each of the two counter-rotating shafts 8 and 9, respectively.

This case is considered, as far as is known by the inventor, in patents GB 975,436, DE 1,165,442 and U.S. Pat. No. 3,486,478. However, it is not known to have been produced commercially. A full explanation is given below with an objective note on the practical difficulty of actuating the automatic control device of the two clutches.

Clutches 19 and 20 are automatically activated one at a time, before each command tending to make stalk 1 rotate, by a mechanism integrated in the steering system and comprised of gears 14,15,16,17 and their shafts. The clutch operated, that is to say disengaged, is the one relative to the shaft which, for that rotation is caused to slip.

An auxiliary device, omitted from the diagram, permits both clutches to be disengaged simultaneously.

The use of an auxiliary rudder is advisable for small alterations of course.

In general this type of transmission can be adopted for ferries and tugs as well as sailing boats with an auxiliary motor.

FIGS. 5 and 7 (the lower part of FIG. 7 is the same as in FIG. 5 ) concern the case in which a differential unit 21 is interposed between the drive shaft 10 and the two counter-rotating shafts 8,9 of the stalk, followed by two pairs of gears 22 with 23 and 24 with 25 of equal ratio, gears 23 and 25 being associated with shafts 8 and 9 respectively.

In this mode the torque is distributed equally, by the presence of differential 21, to two counter-rotating shafts 8,9 in motion, even if one of them accomplishes greater rotation than the other.

Conditions thus exist for free rotation of the stalk with the transmission in operation.

The presence of the differential is considered in U.S. Pat. No. 3,094,967 abovementioned, the operation of which nevertheless depends on the interposition of a reverse mechanism between differential and stalk, indicated by 22–25 in FIG. 1 of that patent.

According to the present invention, on the other hand, the particular arrangement of the parts in the unit enables this reverse mechanism to be eliminated and the stalk to be raised in a vertical plane and, naturally, the propeller axis to be orientated on the horizontal plane.

In FIG. 5 movement is transmitted to the satellites of the differential by means of a cross integral to shaft 10 while in FIG. 7 the movement is transmitted by means of a bell 27; in both cases crown wheels 28 are each integral to a bevel gear which transmits the movement, each through its own conjugate, to vertical coaxial shafts 8,9.

The mechanism of FIG. 5 is more compact, while that of FIG. 7 is constructively simpler.

Figure 8:
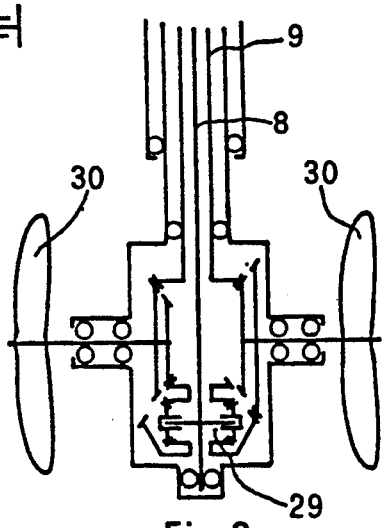
Figure 9:
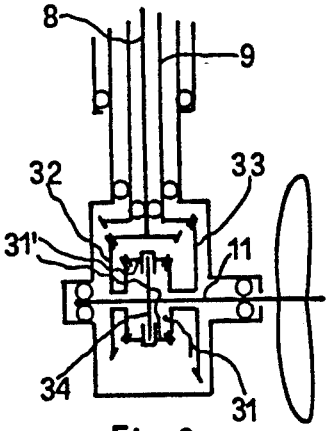
Figure 10:
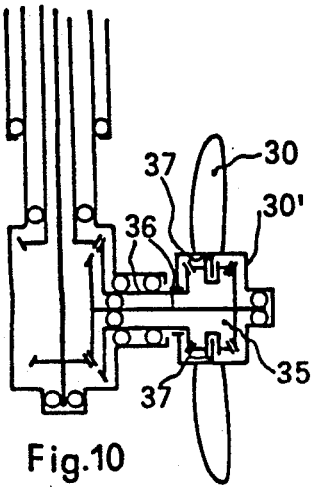
Figure 6:
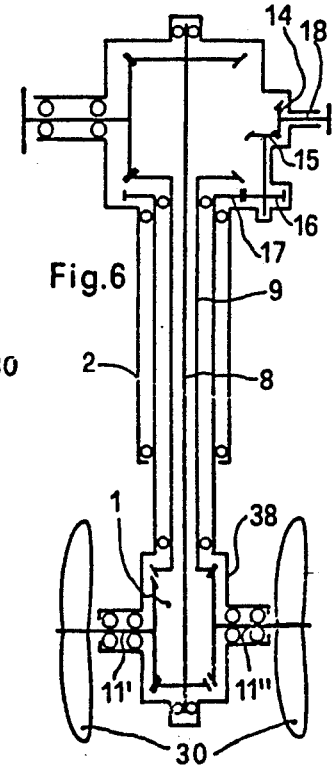

In addition to the mechanisms outlined in FIGS. 5 and 7, the differential can be positioned close to the propeller as in FIGS. 8,9 and 10, the upper parts of which are the same as in FIG. 6.

In FIG. 8, the movement of each of the two coaxial shafts 8,9 is transmitted separately to two opposite counter-rotating propellers 30, one of the two shafts (the central one 8 in the case of FIG. 8) transmitting it through a differential gear 29.

This embodiment shown in FIG. 8 can alternatively have a differential connected to the external shaft and various arrangements can be used for the gears within the casing of stalk 1.

In case [FIG. 8] the torque transmitted to differential 29 positioned in proximity to the propeller is half that transmitted by differential 21 placed in the upper part or casing 2 in the arrangements shown in FIGS. 5 and 7.

In FIG. 9 differential 31 is positioned between final bevel gears 32,33 and the propeller shaft 11 has a cross 4 which carries the satellites 31' of differential 31.

In FIG. 10 differential 35 is placed between two coaxial horizontal shafts 36, rotating in the same direction, and propeller 30. The propeller hubs 30' have integral pins 37 on which the satellites rotate.

In all of these cases in FIGS. 5,7,8,9 and 10, the interposition of a friction clutch after the motor is necessary.

FIG. 6 concerns the case in which, in casing 38 of stalk 1, each of counter-rotating shafts 8,9 transmits its torque through a pair of bevel gears to separate propeller shafts 11' and 11" which necessarily in the diagram are off-center. Thus stalk 1 is free to turn and the usual system of gears transmits the command for it to rotate. In this case a condition is imposed by the considerations first expressed, that is to say that the torques transmitted by the two counter-rotating shafts 8 and 9 should be equal so that the reaction of these moments on stalk 1 be none. Here this condition is approached as the difference between the power absorbed by the two propellers 30 tends to zero.

FIGS. 11,12,13,14 and 15, the upper parts of which are the same as in FIG. 6, outline mechanisms based on the same principal as FIG. 6

Figure 12:
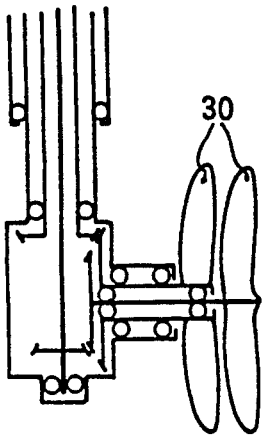
Figure 13:
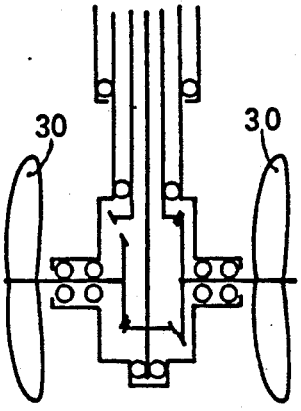
Figure 14:
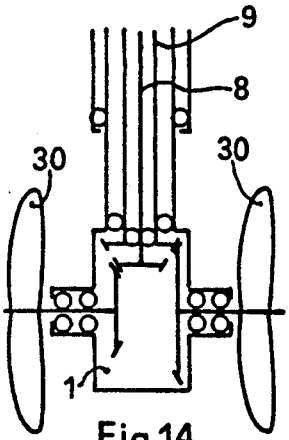

In FIG. 11 movement arrives at two counter-rotating adjacent coaxial propellers 30 of a type widely used for some time. FIGS. 12 and 15 represent two mechanisms which transmit movement to two adjacent coaxial propellers 30 rotating in the same direction. The hydrodynamic characteristics of this pair of propellers are predictable but not known. In FIGS. 13 and 14 the propellers are arranged as in FIG. 6 but are coaxial: in FIG. 13 they are counter-rotating while in FIG. 14 they rotate in the same direction.

For all of these mechanisms outlined in the cases of FIGS. 6,11,12,13,14 and 15, which are relatively simple, the interposition of a friction clutch after the motor is necessary.

The types of transmissions outlined in FIGS. 5 to 15 are for general use.

In addition to these applications of a marine character, the invention in all of its forms of execution can be used in other sectors such as wind energy and/or aeronautics.

In the wind energy sector, by connecting a wind-driven propeller to an electricity generator or other fixed utility machine (FIG. 16) and orientating the axis of the propeller 39 in the direction of the wind, using one of the mechanisms outlined above for the transmission, the direction of the propeller can be controlled by the force of vane 40 orientated by the wind alone, or a low-power automatic control can by used.

In aeronautics, in VTOL aircraft (FIG. 17), it is necessary, with a fixed engine and with power transmission in operation, to vary the orientation of the axis of the propeller (or propellers) from the vertical take off position to that of horizontal flight. Using one of the above transmissions the required result is obtained with a low-power control mechanism.

The invention is further described here by three practical examples which reflect the cases in FIGS. 5,7 and 11.

The execution of a transmission according to the arrangement of FIG. 5 is illustrated in FIGS. 18 and 19.

Drive shaft 41, with a friction clutch and a flexible coupling 42, exits from the stern 43 and enters casing 44 where, by means of a pair of bevel gears 45,46, it turns shaft 47 (corresponding in practice to drive shaft 10 in the diagrams of FIGS. 3 to 15) which has four orthogonally arranged pins 48 carrying four bevel satellites 49 all engaging two crown wheels 50: this coupling constitutes the differential (indicated by 21 in FIG. 5).

Bevel gears 50 are each integral with gears 51 and 52 which transmit the movement, in the same ratio, to vertical counter-rotating shafts 53 and 54 by means of their conjugates 55 and 56.

An ordinary reverse mechanism of transmission to the counter-rotating propellers 57 and 58, the operation of which can be immediately understood, completes the transmission.

The mechanism of the command is constituted by the transmission comprising shaft 59' (corresponding to the steering shaft 19 in the diagrams of FIGS. 3-15) and gears 59,60,61 and 62, the final gear 62 being integral through hollow shaft 63 with stalk 64 containing the propeller shafts.

An hydraulic cylinder 65, rotating part 66, and hence also stalk 64 around bushes 67 and 68 coaxially with shaft 47 and shaft 59', stabilises the angle at which the propeller axes are raised on the vertical plane.

A simple device 69 prevents stalk 64 from being raised when the propulsive thrust is directed astern but does not prevent it from being raised forcibly on striking an obstacle, for example.

By traction on a steel cable 70, which engages a pulley 71, it is possible to raise the assembly 64,66 completely, for example for inspection and/or to polish the propeller.

The execution of a transmission according to the arrangement of FIG. 7 is illustrated in FIG. 20, in which the lower part is identical to that of FIGS. 18 and 19.

Motive power reaches bell 72 by means of a bevel gear 73 integral thereto. The bell 72 has pins 74 on which satellites 75 turn simultaneously engaging crown wheel 76, integral to shaft 77, and crown wheel 78 which forms a part of bevel gear 79.

Shaft 77 transmits the movement of crown wheel 76 to bevel gear 80. Thus the motive power arrives in two parts, through the differential, at the vertical internal 81 and external 82 counter-rotating shafts.

The rest of the mechanism is identical to that illustrated in preceding FIGS. 18 and 19.

Clearly drive shaft 77 is coaxial with steering shaft 59' in this case as well and hence it is also possible to rotate the whole assembly around their common axes to raise it.

The execution of a transmission according to the arrangement of FIG. 11 is illustrated in FIG. 21 applied to a hull (planing type) designed for two engines and two "Z" type transmissions according to the arrangement of FIG. 22 which represents the same hull seen from above.

Note the particular shape of the stern to enable the transmission to exit out-board through longitudinal vertical walls 83 and 84 (the right one 84 is also indicated in FIG. 21). The steering controls on panel 85 pass through the vertical transversal walls 86,87.

Referring particularly to FIG. 21 the driving torque arrives at shaft 88' and thus to bevel gear 88 through a friction clutch 89 and flexible joint 90 and is distributed through gear 91 and 92 to coaxial counter-rotating shafts 93 and 94. These transmit the movement to the counter-rotating propellers 95 and 96 situated on stalk 97 (which is shown turned through 90° to the normal direction), each separately through two pairs of bevel gears 98 and 99 to two internal 100 and external 101 coaxial shafts corresponding respectively to 11' and 11" on the diagram of FIG. 11.

Propeller 96 is variable pitch (conventional) with external adjustment to enable the torque transmitted from the two vertical counter-rotating shafts to be rendered equal.

In the case also, the whole assembly rotates on the drive shaft axis by means of bushes 102 and 103 in order to vary the attitude or to raise the stalk with cable 104 and, as in all the above illustrated cases, said drive shaft 88' is coaxial with shaft 105 representing the steering torque.

Steering control is transmitted, by means of the pinion by a chain 106 and said shaft 105, to the internal gears, as described by FIG. 18.

I claim:

1. A "Z" type power transmission for transmitting power from a first drive shaft to a second drive shaft comprising:

a first housing having said first drive shaft and steering control means mounted therein, wherein said first housing is mounted for selective pivotal movement about the axis of said first drive shaft; wherein said transmission may be pivoted about said axis of said first drive shaft while maintaining drive power and steering control;

a steerable second housing responsive to said steering control means rotatably mounted to said first housing and having said second drive shaft mounted therein; and means for transmitting power from said first drive shaft in said first housing to said second drive shaft in said second housing, including counter rotating coaxial drive shaft means intermediate said first drive shaft and said second drive shaft.

2. The "Z" type power transmission of claim 1 wherein said steering control means includes a steering drive shaft mounted to said first housing such that said steering drive axis is substantially coincident with the axis of said first drive shaft.

3. The "Z" type power transmission of claim 1 further comprising gear means including two bevel gears mounted within said first housing intermediate said coaxial drive shafts and said first drive shaft.

4. The "Z" type power transmission of claim 2 further comprising gear means including two bevel gears mounted within said first housing intermediate said coaxial drive shafts and said first drive shaft.

5. The "Z" type power transmission of claim 3 wherein said gear means includes a cross with satellites mounted within said first housing and arranged to engage said bevel gears.

6. The "Z" type power transmission of claim 4 wherein said gear means includes a cross with satellites mounted within said first housing and arranged to engage said bevel gears.

7. The "Z" type power transmission of claim 3 further comprising a gear-type differential mounted within said first housing between said first drive shaft and said bevel gears.

8. The "Z" type power transmission of claim 4 further comprising a gear-type differential mounted within said first housing between said first drive shaft and said bevel gears.

9. The "Z" type power transmission of claim 1 wherein said second drive shaft is further comprised of coaxial drive shaft members.

10. The "Z" type power transmission of claim 2 wherein said second drive shaft is further comprised of coaxial drive shaft members.

11. The "Z" type power transmission of claim 9 wherein at least one of said coaxial drive shaft members of said second drive shaft is driven through a differential gear.

12. The "Z" type power transmission of claim 10 wherein at least one of said coaxial drive shaft members of said second drive shaft is driven through a differential gear.

13. The "Z" type power transmission of claim 9 wherein said coaxial drive shaft members of said second drive shaft are driven in opposite directions.

14. The "Z" type power transmission of claim 10 wherein said coaxial drive shaft members of said second drive shaft are driven in opposite directions.

15. The "Z" type power transmission of claim 9 further comprising ross and satellite gear means positioned between said coaxial drive shafts of said power transmitting means and said coaxial drive shaft members of said second drive shaft.

16. The "Z" type power transmission of claim 10 further comprising cross and satellite gear means positioned between said coaxial drive shafts of said power transmitting means and said coaxial drive shaft members of said second drive shaft.

17. The "Z" type power transmission of claim 1 wherein said second drive shaft comprises dual shafts driven by said coaxial drive shafts of said power transmitting means respectfully, and further comprises dual propellers mounted to said dual shafts, and means to vary the pitch of at least one of said propellers.

18. The "Z" type power transmission of claim 1 further comprising overrunning clutches interposed between said first drive shaft and said counter rotating shafts of said coaxial drive shaft means.

19. The "Z" type power transmission of claim 2 further comprising overrunning clutches interposed between said first drive shaft and said counter rotating shafts of said coaxial drive shaft means.

20. The "Z" type power transmission of claim 1 further comprising friction clutches interposed between said first drive shaft and said counter rotating shafts of said coaxial drive shaft means.

21. The "Z" type power transmission of claim 2 further comprising friction clutches interposed between said first drive shaft and said counter rotating shafts of said coaxial drive shaft means.

* * * * *